US005652736A

United States Patent [19]

Lee

[11] Patent Number: 5,652,736

[45] Date of Patent: Jul. 29, 1997

[54] ORNAMENTAL CONTAINER DETACHABLY ATTACHED TO WRIST WATCH

[76] Inventor: Vincent Kuo Wei Lee, No. 44, Lane 458, Sheh Chung Street, Taipei, Taiwan

[21] Appl. No.: 664,676

[22] Filed: Jun. 17, 1996

[51] Int. Cl.[6] ..... G04B 47/06; G04B 37/00

[52] U.S. Cl. ..... 368/278; 368/283; 368/286

[58] Field of Search ..... 368/10, 88, 276–278, 368/283, 286, 309

[56] References Cited

U.S. PATENT DOCUMENTS

| | | | |
|---|---|---|---|
| 2,565,822 | 8/1951 | McClelland | 368/286 |
| 2,582,473 | 1/1952 | Belfert | 368/286 |
| 2,636,338 | 4/1953 | Dintsman | 368/283 |
| 4,183,206 | 1/1980 | Porsche et al. | 368/278 |
| 4,444,513 | 4/1984 | Proellochs | 368/283 |
| 4,964,093 | 10/1990 | Hiranuma et al. | 368/283 |

*Primary Examiner*—Vit W. Miska
*Attorney, Agent, or Firm*—Bacon & Thomas

[57] ABSTRACT

Disclosed is an ornamental container detachably attached to a wrist watch. The ornamental container is pivotally connected to an upper supporting frame which cooperates with a pair of lower U-shaped fixing members to sandwich a watch case of the wrist watch between them. The ornamental container is filled with ornamental articles, such as cute floating articles drifting on dual-liquid, and is normally closed to the supporting frame over the dial of the wrist watch. When a werarer wants to check time, the ornamental container can be pivotally lifted to expose the dial.

4 Claims, 6 Drawing Sheets

ORNAMENTAL CONTAINER DETACHABLY ATTACHED TO WRIST WATCH

BACKGROUND OF THE INVENTION

There are various kinds of personal ornaments available on the markets. These ornaments are novel and attract many people. For example there is a type of disposable plastic injection molded ornament, which is provided at a bottom with adhesive so that it may be easily adhered to an earlobe to replace an earring. Such disposable ornament is simple and can be selected and used completely according to one's preference. There is also a novel ornament which can be differently designed and is provided with velcro tapes so that it may be detachably attached to shoes to match with the user's wear. All of these simple but changeful and personalized ornaments indicate that novel and personalized ornaments are increasingly welcomed in the markets by both the manufacturers and the consumers. On the other hand, the use of such changeful and personalized ornaments shall still meet some rules, such as they should not be used in a manner that is too strange or against the common custom of the public, for example, decorating the nose with some ornament. In brief, such novel and personalized ornaments must be used at somewhere which is generally acceptable by the public. For example, an ornament put on a wrist. That is why wrist watch has been a lasting and practical ornament. The wrist watches available on the markets can be generally divided into mechanical and electronic types. However, there are thousands of appearance designs for wrist watches. The wrist watch has changed from a purely daily necessity to an ornament for showing some personal style. Some people owns different wrist watches to use them in different occasions. There is a wrist watch sold on the market under the brand of "SWATCH". The wrist watches of SWATCH brand include a series of different designs which each has its own features and have received recognitions from every corners of the markets. However, these wrist watches are so expensive that not every one can buy a number of them as a personal collection or ornaments. It is therefore tried by the inventor to develop a means which is simple in structure and not expensive in price and can be detachably attached to a wrist watch to contain different ornaments therein, making the one single wrist watch a changeful ornament.

SUMMARY OF THE INVENTION

A primary object of the present invention is to provide an ornamental container detachably attached to a wrist watch. The container has different ornaments disposed therein and can be replaced at any time as desired, making the wrist watch a changeful ornament and a time piece at the same time.

The ornamental container attached to a wrist watch according to the present invention includes a closed container which is pivotally connected to a supporting frame removably mounted to a top of the wrist watch. The supporting frame has a central opening to expose a dial of the wrist watch. The container accommodates therein different ornaments, such as single or dual liquid ornaments, allowing the wrist watch to simultaneously function like a novel ornament. Since the ornamental container of the present invention can be easily replaced with other ones of different designs according to the user's preference, only one single wrist watch can be used to show a variety of personalized ornaments.

DETAILED DESCRIPTION OF THE PREFERRED EMBODIMENTS

Figure 1:
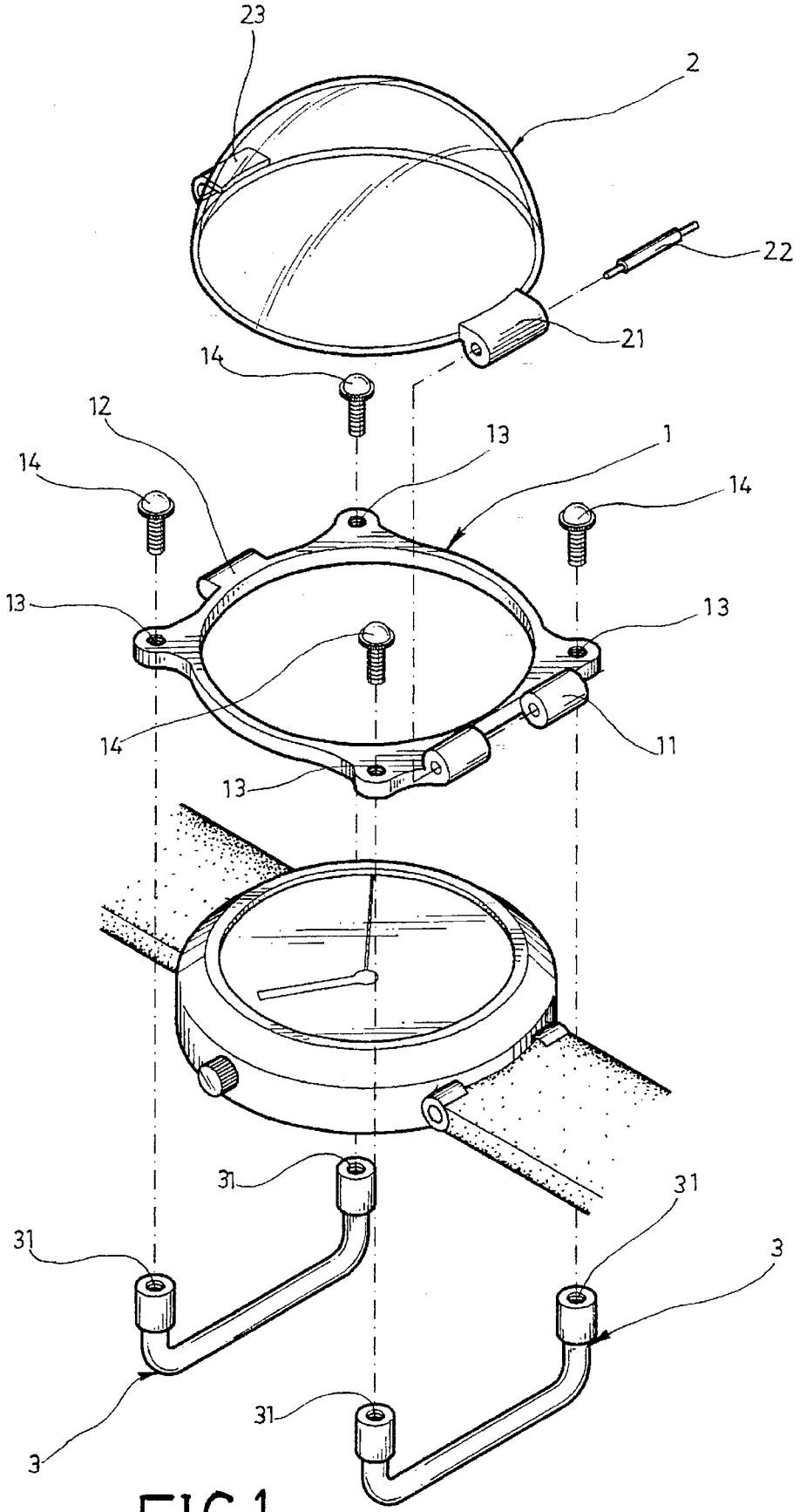
FIG. 1 is an exploded perspective of a first embodiment of the ornamental container detachably attached to wrist watch according to the present invention.

Please refer to FIG. 1 in which a first embodiment of an ornamental container detachably attached to a wrist watch according to the present invention is shown. The present invention mainly includes a supporting frame 1, an ornamental container 2, and a pair of U-shaped fixing members 3.

The supporting frame 1 is a suitably rigid, thin and flat member and is preferably integrally formed from plastic material by injection molding. The supporting frame 1 has a central round opening of a size about a dial of a wrist watch, so that the dial of the wrist watch can still be exposed when the supporting frame 1 is laid over a top of the wrist watch. A pair of retaining members 11 are provided to an outer periphery of the supporting frame 1 at a suitable position, preferably at a position corresponding to a joint of the dial with a wrist watch band. A projected key 12 is provided to the outer periphery of the supporting frame 1 opposite to the pair of retaining members 11. Four lugs each having a central through hole 13 are formed on the outer periphery of the supporting frame 1 at four corners.

The ornamental container 2 is a suitably sized closed hollow case. The container 2 may be of any shape. However, to match with the substantially round dial of the wrist watch, a semispheric shape is most preferred. A sleeve 21 is provided on an outer edge of the container 2 so that it may be engaged between the pair of retaining members 11 of the supporting frame 1 and be pivotally fixed thereto by means of a pin 22 threading therethrough. That is, the container 2 may be pivotally turned upward or downward about the pin 22 relative to the supporting frame 1. Further, a catcher 23 is provided to the outer edge of the container 2 opposite to the sleeve 21, so that the catcher 23 shall releasably engage with the projected key 12 of the supporting frame 1, allowing the container 2 to be closed and firmly held to the supporting frame 1.

The U-shaped fixing member 3 each is preferably integrally formed to have two diameter-properly-expanded free ends. Each of the expanded free end is formed with an internally threaded hole 31 to correspond to one of the through holes 13 on the lugs of the supporting frame 1.

Figure 2:
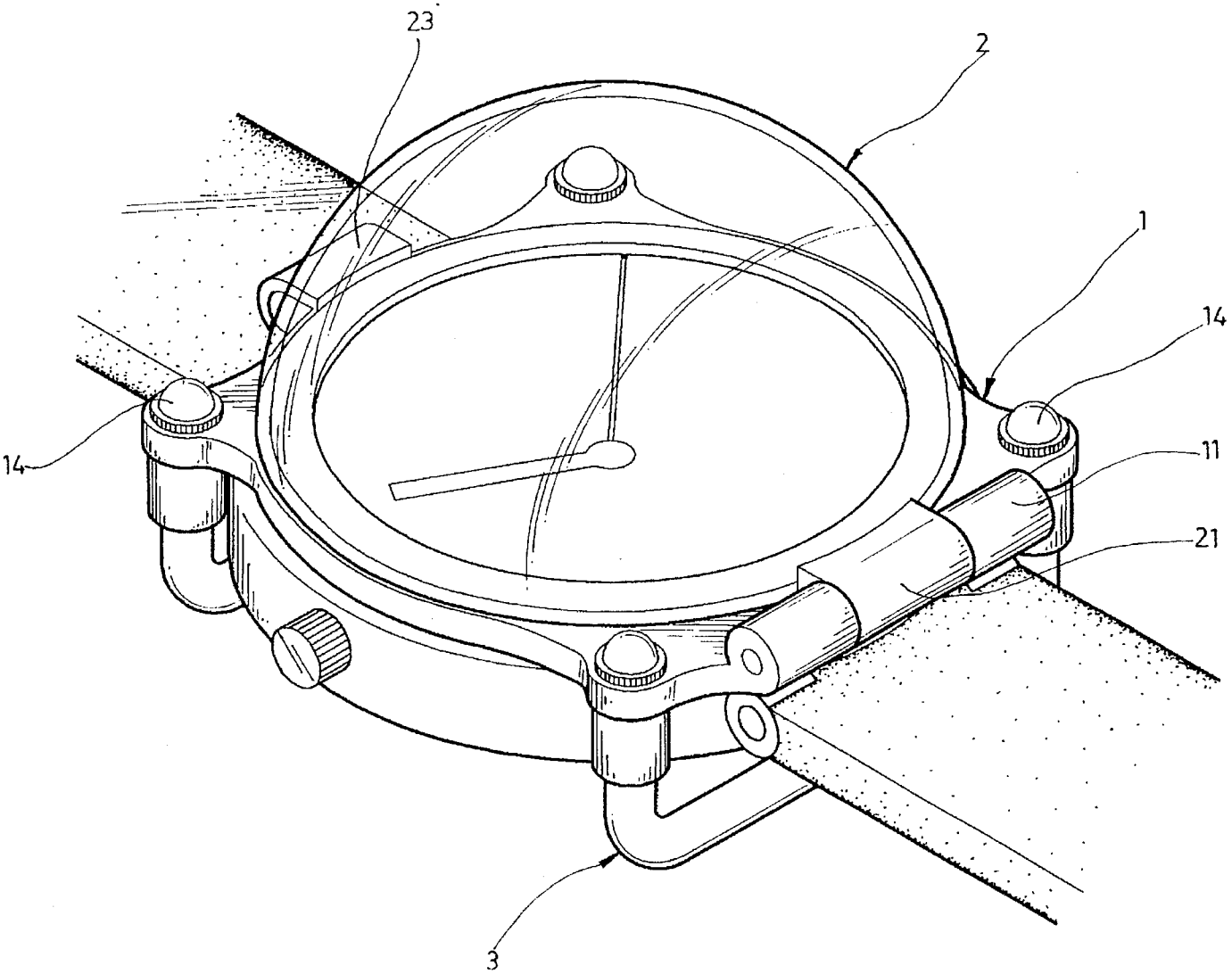
FIG. 2 is a perspective showing a wrist watch with the ornamental container of the present invention attached thereto.

By positioning the supporting frame 1 over the dial of the wrist watch and threading screws 14 downward into the threaded holes 31 via the through holes 13, a whole watch case of the wrist watch is sandwiched between the firmly connected supporting frame 1 and U-shaped fixing members 3. Generally, the wrist watch bands have sizes within a certain limited range. Thus, the U-shaped fixing members 3 may have a span within the range corresponding to that of the wrist watch bands. Similarly, two through holes 13 located at two sides of a wrist watch band may be spaced by a distance the same as the span of the U-shaped fixing members 3. With this arrangement, the U-shaped fixing members 3 may be separately positioned below the watch bands abutting on the watch case with their two free ends extending upward to connect with the supporting frame 1 by means of screws 14, as shown in FIG. 2. In this mounting manner, the assembled ornamental container of the present invention attached to the wrist watch will not cause any discomfort to the wearer. Moreover, operation of any winding button of the wrist watch located at one side of the watch case will not be influenced by the mounted supporting frame 1.

Figure 5:
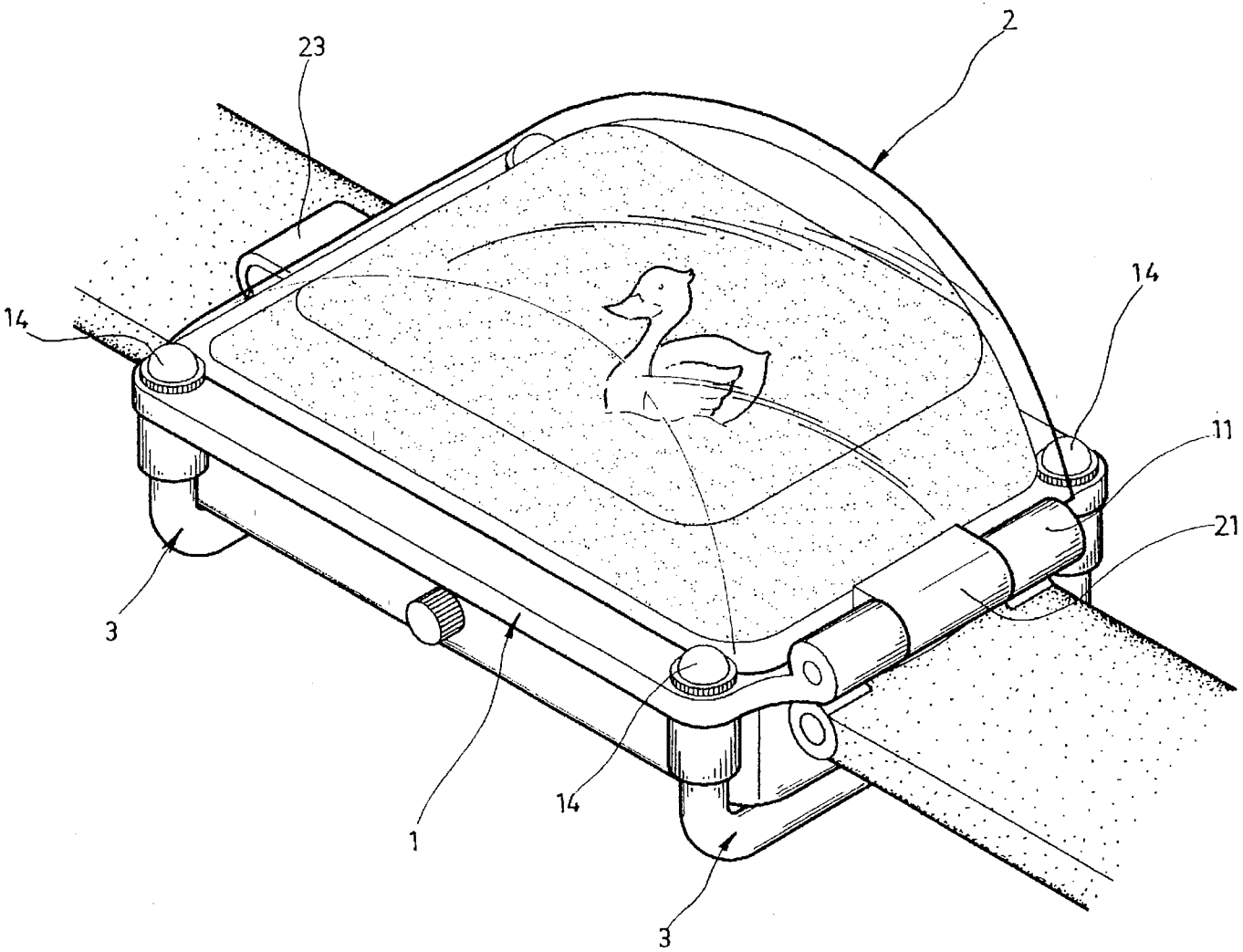
FIG. 5 shows another embodiment of the present invention.

FIG. 5 illustrates another embodiment of the present invention in which the wrist watch has an oblong case. In this embodiment, the supporting frame 1 is changed to have a longer length but can still have a width corresponding to the general width of watch bands without the necessity of changing the U-shaped fixing members 3. This is, of course, an advantage in an economical production of components of the present invention. To match with the oblong supporting frame 1, the ornamental container 2 may be designed to have a shape corresponding to the supporting frame 1.

Figure 3:
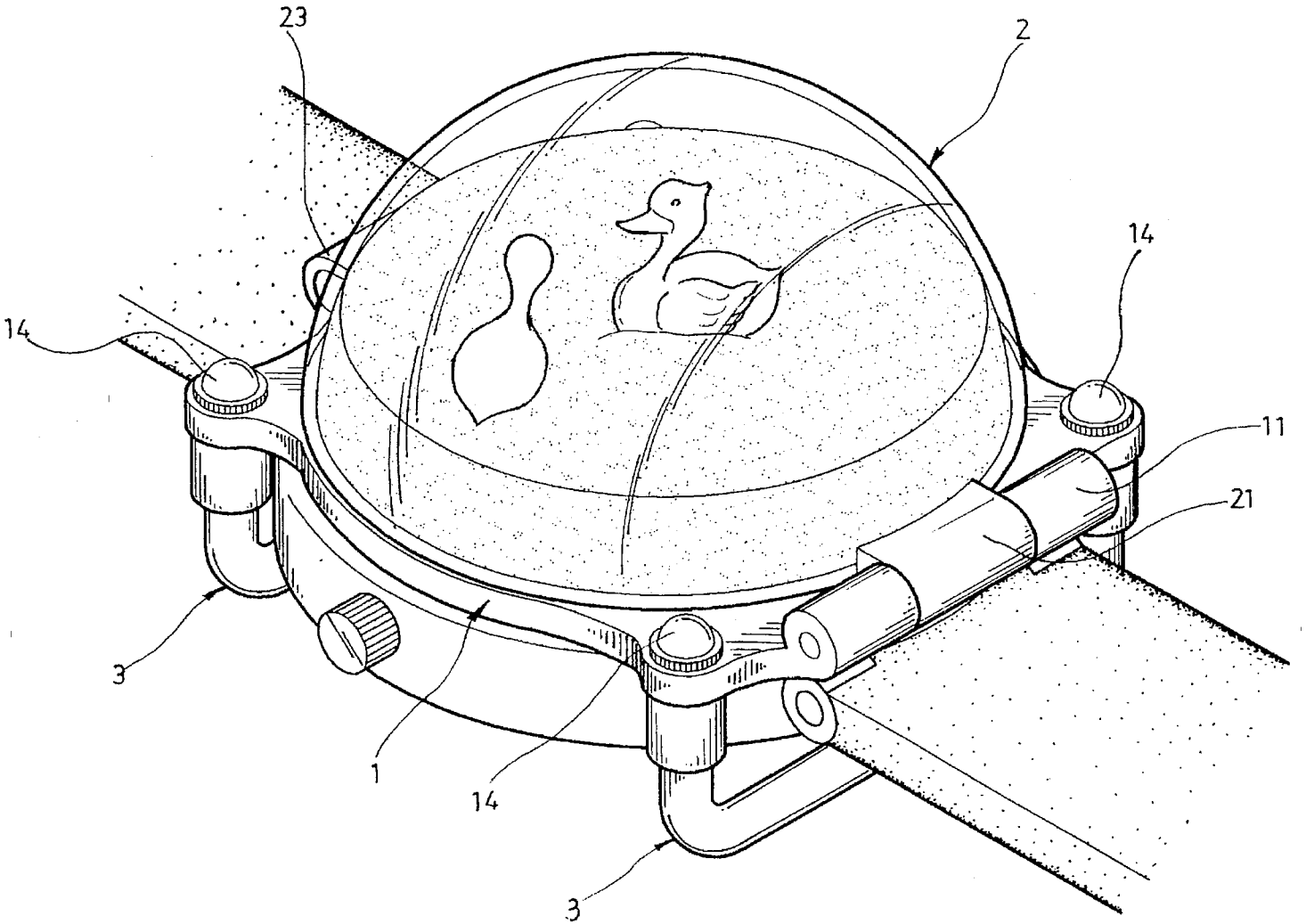
FIG. 3 is similar to FIG. 2 but with ornaments disposed in the container of the present invention.
Figure 6:
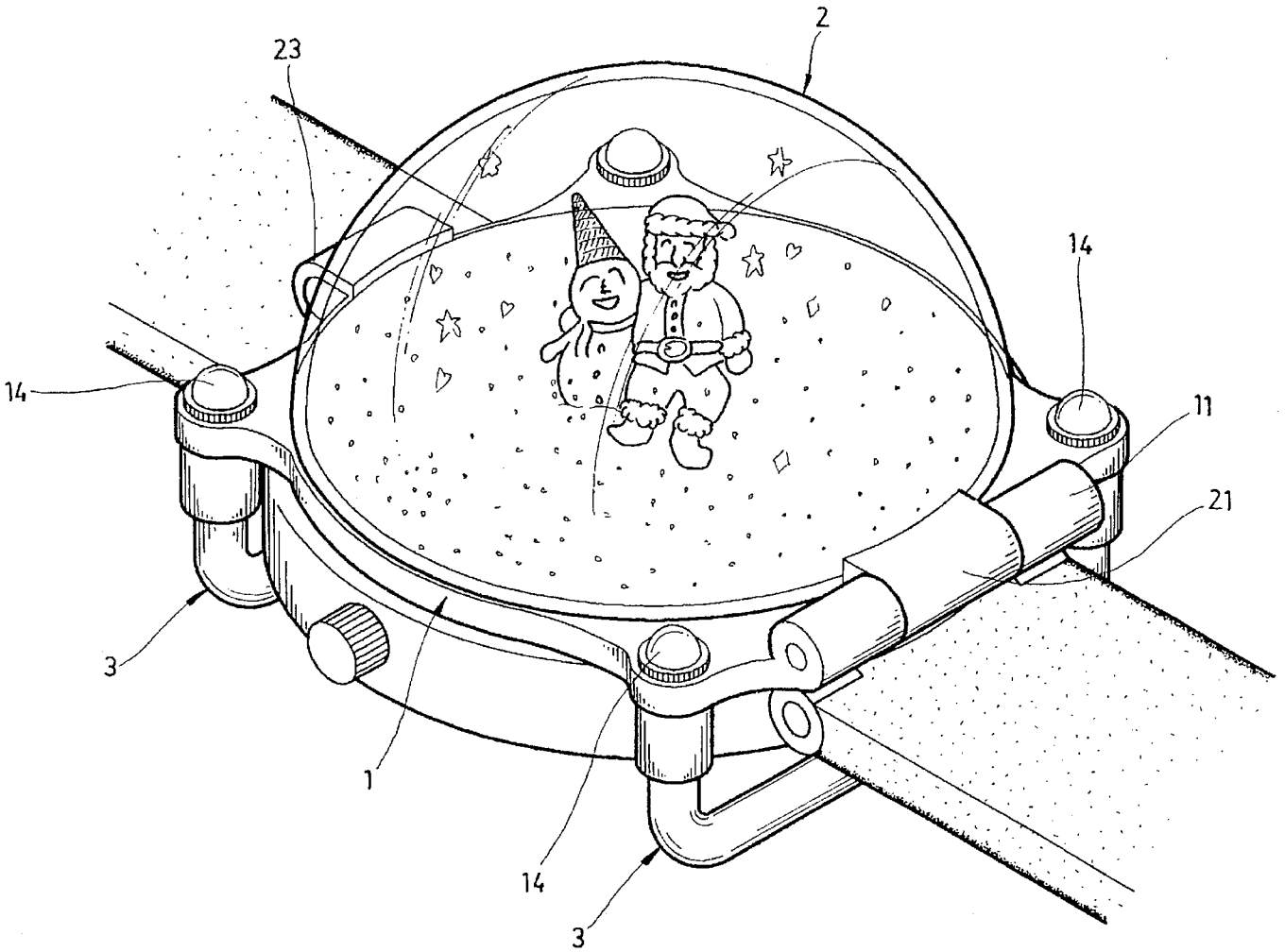
FIG. 6 shows a further embodiment of the present invention.

The ornamental container 2 is preferably made of clear material so that ornaments disposed thereinside can be clearly viewed. For the ornamental container 2 to be novel and unique and full of dynamic and changeful beauty, a dual-liquid and some floating articles can be filled in the container 2, as shown in FIG. 3. Alternatively, a single-liquid and some ornaments and decorations can be filled in the container 2 to shown a special scene, as shown in FIG. 6. The movement of hand wearing the wrist watch and therefore the ornamental container of the present invention permits the liquids, ornaments and decorations in the container 2 to flow or drift freely to create unique and beautiful scene. Different patterns or pictures may be printed onto a bottom of the ornamental container 2 to match with the internal ornaments and decorations.

Figure 4:
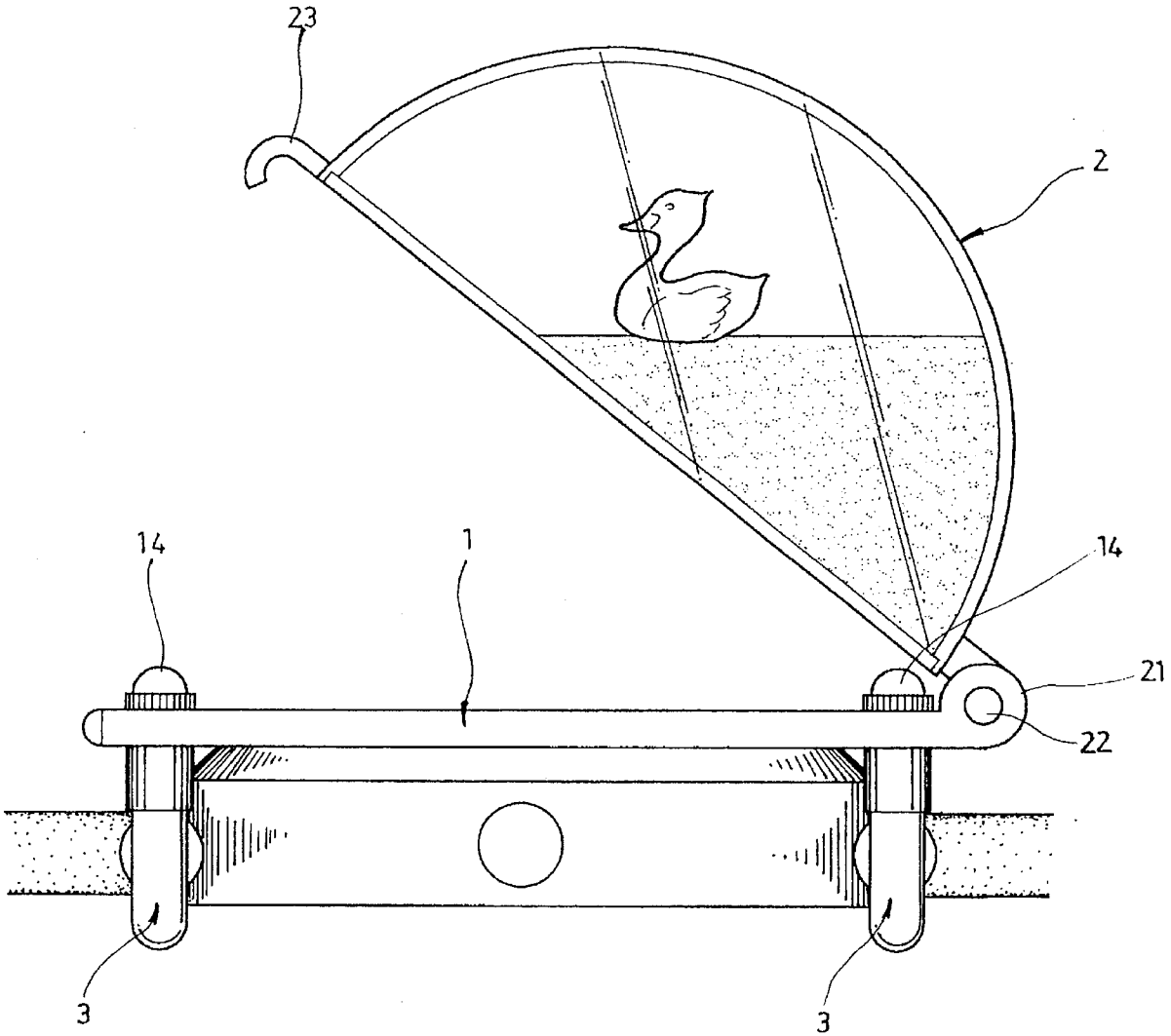
FIG. 4 is a side view illustrating the manner in which the closed ornamental container of the present invention is pivotally turned to show the dial of the wrist watch.

When the wearer wants to check the time, he or she may simply release the catcher 23 of the container 2 from the projected key 12 of the supporting frame 1 and pivotally lift the container 2 to expose the dial of the wrist watch, as shown in FIG. 4.

What is claimed is:

1. An ornamental container detachably attached to wrist watch, comprising a supporting frame, two U-shaped fixing members cooperable with said supporting frame to sandwich a watch case of said wrist watch therebetween, and an ornamental container pivotally connected to said supporting frame so that said container can be covered to a top of said supporting frame or be lifted to expose a dial of said wrist watch, and said container being filled with different ornaments, decorations or liquid and being replaceable by a wearer as desired.

2. An ornamental container detachably attached to wrist watch as claimed in claim 1, wherein said supporting frame is a suitably rigid, thin and flat member having a central opening shaped and sized to meet a shape and size of said dial of said wrist watch, said supporting frame being provided on an outer periphery at a suitable position with a pair of retaining members, on said outer periphery opposite said two retaining members with a projected key, and on said outer periphery at four corners with four lugs each having a central through hole.

3. An ornamental container detachably attached to wrist watch as claimed in claim 2, wherein said U-shaped fixing member each is integrally formed to have two diameter-properly-expanded free ends, each of said expanded free end being formed with an internally threaded hole to correspond to one of said through holes on said lugs of said supporting frame, whereby said supporting frame is connected to said U-shaped fixing members with said watch case of said wrist watch sandwiched between them by threading screws down into said through holes on said lugs and said threaded holes on said U-shaped fixing members.

4. An ornamental container detachably attached to wrist watch as claimed in claim 2, wherein said ornamental container can be of any shape and is most preferably a semispheric case, said ornamental container being provided on an outer edge with a sleeve and on said outer edge opposite said sleeve with a catcher, said sleeve being engaging between said pair of retaining members of said supporting frame and pivotally fixed thereto by means of a pin threading therethrough, and said catcher being releasably engaged with said projected key of said supporting frame, allowing said container to be closed and firmly held to the supporting frame.

* * * * *